United States Patent [19]

Morrison

[11] 4,221,527

[45] Sep. 9, 1980

[54] REFUSE TRUCK BODY

[75] Inventor: George W. Morrison, Seal Beach, Calif.

[73] Assignee: Universal Truck Body, Inc., Los Angeles, Calif.

[21] Appl. No.: 13,033

[22] Filed: Feb. 21, 1979

[51] Int. Cl.[3] ..... B65F 3/28

[52] U.S. Cl. ..... 414/517; 414/525 R

[58] Field of Search ..... 414/509, 510, 511–517, 414/525

[56] References Cited

U.S. PATENT DOCUMENTS

| | | | |
|---|---|---|---|
| 1,769,939 | 7/1930 | Berasi . | |
| 2,750,055 | 7/1956 | Huffines . | |
| 2,865,286 | 12/1958 | Newell . | |
| 2,996,202 | 8/1961 | Neyland . | |
| 2,996,203 | 8/1961 | Rosaia . | |
| 3,231,111 | 1/1966 | Clar . | |
| 3,451,571 | 6/1969 | Brisson . | |
| 3,750,813 | 8/1973 | Fishburne . | |
| 3,815,765 | 6/1974 | Moser et al. | 414/512 |
| 3,995,694 | 5/1976 | Herpich . | |

*Primary Examiner*—Robert G. Sheridan
*Attorney, Agent, or Firm*—Lyon & Lyon

[57] ABSTRACT

A refuse truck body has an ejector which, in its forward position, divides the interior of the body into a loading compartment and a storage chamber. A compactor plate on the lower portion of the ejector is movable between a first position in which a lower surface thereof is inclined downward away from said loading compartment to a second position adjacent the floor of the storage chamber. A pusher element in the lower portion of the loading compartment is movable toward the storage chamber for moving a charge of refuse from the loading compartment under the compactor plate and into the storage chamber. A multiple-extension power cylinder assembly moves the ejector to discharge compacted refuse from the storage chamber.

6 Claims, 5 Drawing Figures

REFUSE TRUCK BODY

This invention relates to side loading refuse truck bodies and is particularly directed to improvements which increase the effective capacity of the refuse storage chamber, and which permit full ejection of the load of refuse without tilting the truck body. A side loading compartment is provided in a forward end of the body and a power operated ejector, in its forward position, forms a wall of the loading compartment. Refuse deposited in the loading compartment is pushed horizontally under an inclined compactor plate forming a part of the ejector, and the refuse is compacted as it passes from the loading compartment into the storage chamber. The storage chamber is bigger at the top to allow the refuse to move upward with less restriction and once in position to allow springback action to oppose its gravity descent. When the storage chamber is full of compacted refuse, the compactor plate is swung to a second position approaching the floor of the storage compartment. This compactor plate then serves as a part of the ejector to move the compacted refuse through a rear opening in the storage chamber.

Other and more detailed objects and advantages will appear hereinafter.

Figure 1:
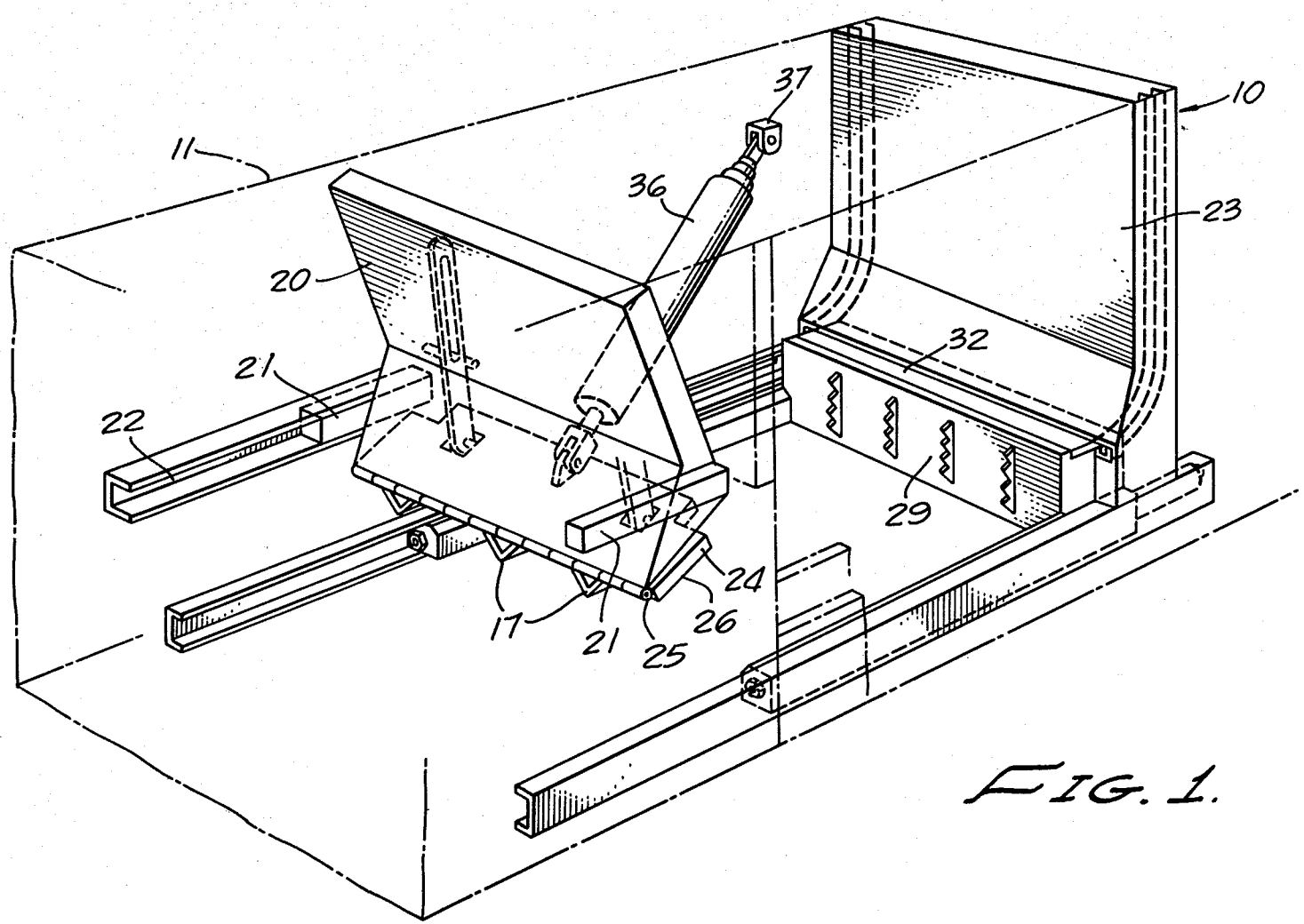
FIG. 1 is a perspective view partly broken away showing a preferred embodiment of this invention.

Referring to the drawings, the refuse truck body 10 has side walls 11 and 12, a ceiling wall 13 and a floor 14 cooperating to form a longitudinal storage chamber 15, and a loading compartment 16 at its forward end. The rearward end of the longitudinal storage chamber has a discharge opening closed by a hinged door, not shown. An ejector 20 is fixed to slide bars 21 which travel in grooved tracks 22 extending longitudinally on the side walls 11 and 12. In its forward position, the ejector 20 defines the rear boundary of the loading compartment 16. The forward boundary of the loading compartment is formed by the forward wall 23 of the truck body 10.

Figure 2:
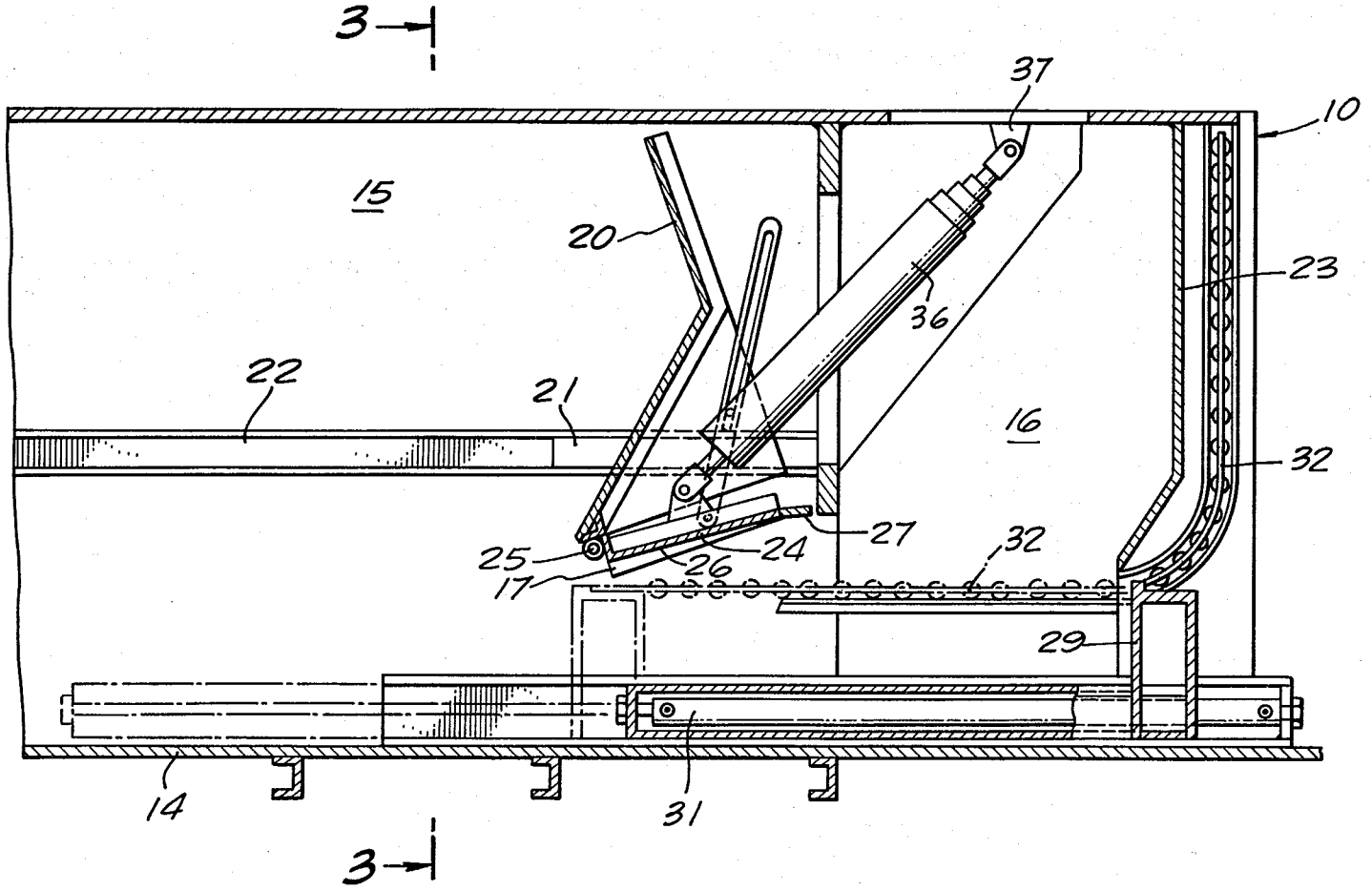
FIG. 2 is a sectional side elevation.
Figure 3:
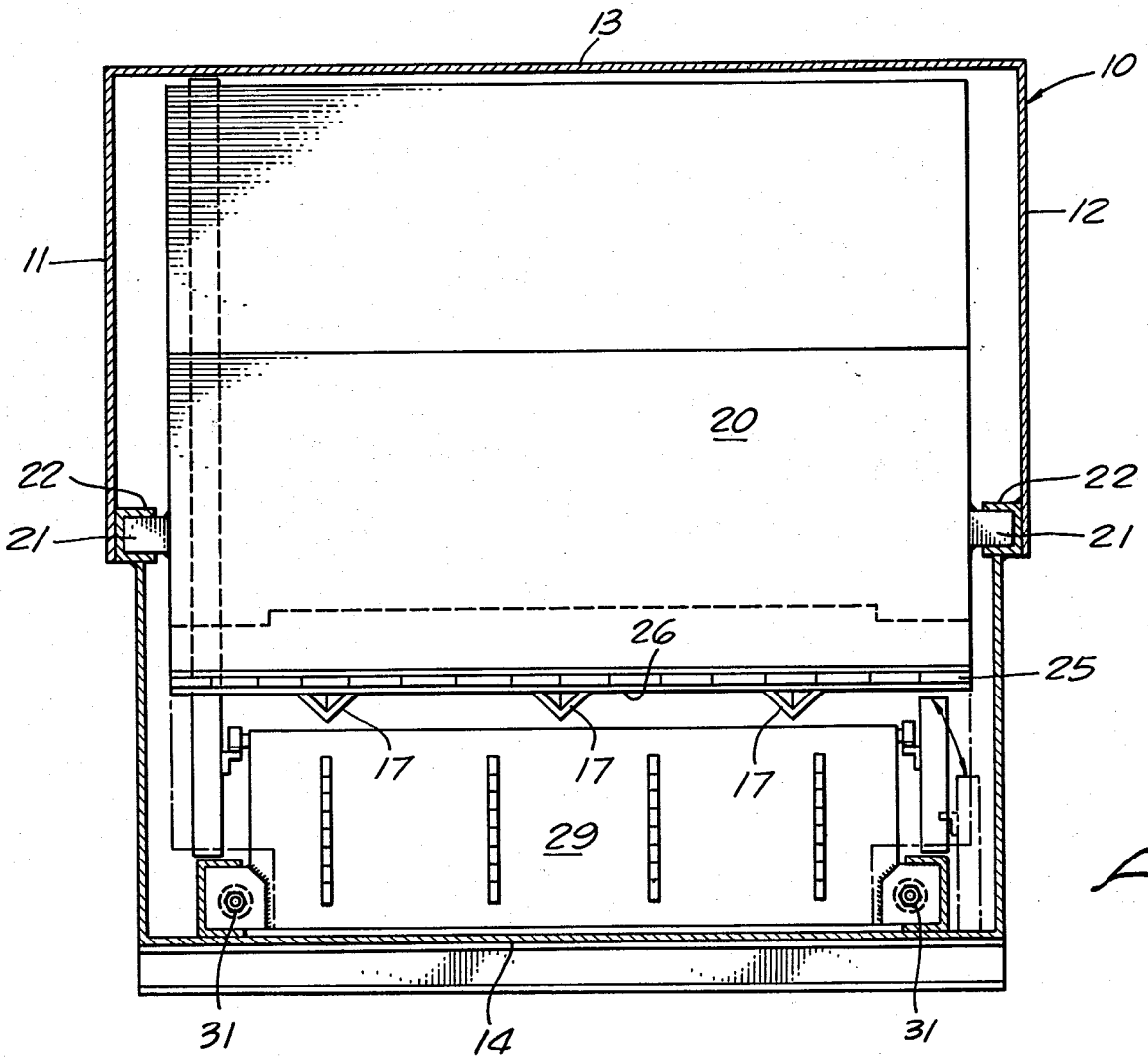
FIG. 3 is a sectional end elevation taken substantially on the lines 3—3 as shown in FIG. 2.
Figure 5:
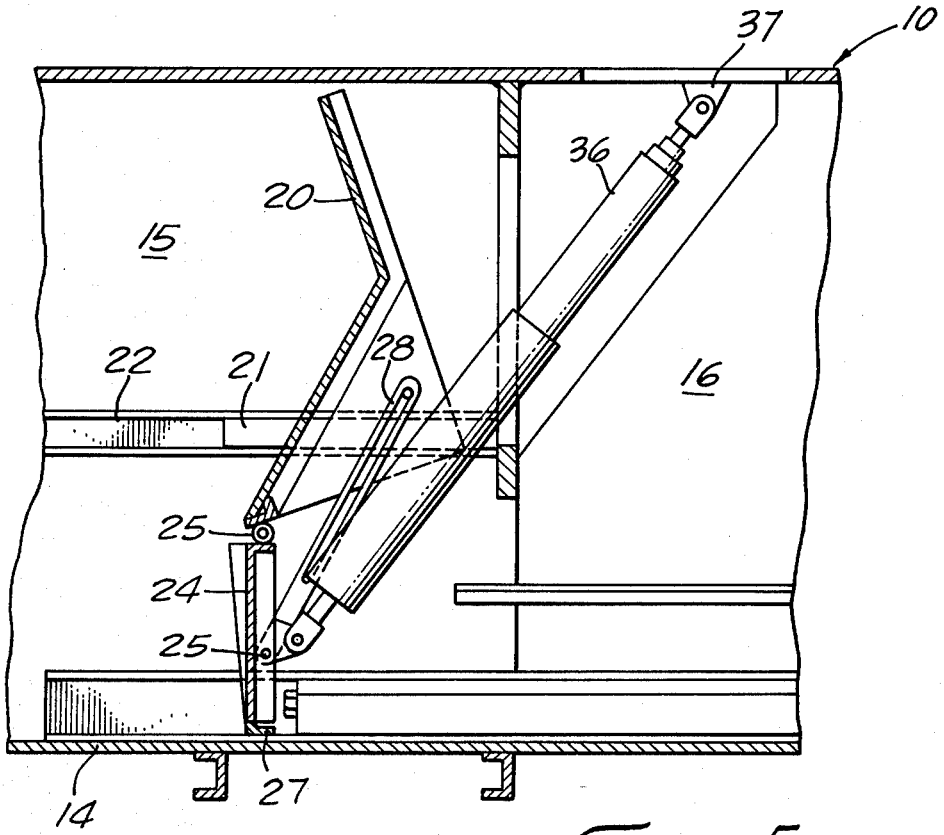
FIG. 5 is a sectional view similar to a portion of FIG. 2, showing the parts in a different position.

The ejector 20 includes a compactor plate 24 connected by a horizontal hinge 25. In a first position of the compactor plate 24 the lower surface 26 thereof is inclined downward away from the loading compartment 16, as shown in full lines in FIGS. 1, 2 and 3 of the drawings. In a second position of the compactor plate 24, as shown in FIG. 5, the lip 27 remote from the hinge 25 is positioned adjacent the floor 14. A slotted link 28 limits angular movement of the compactor plate 24 about the hinge 25. When the compactor plate 24 is in this second position, the ejector 20 substantially fills the cross section of the storage chamber 15.

Figure 4:
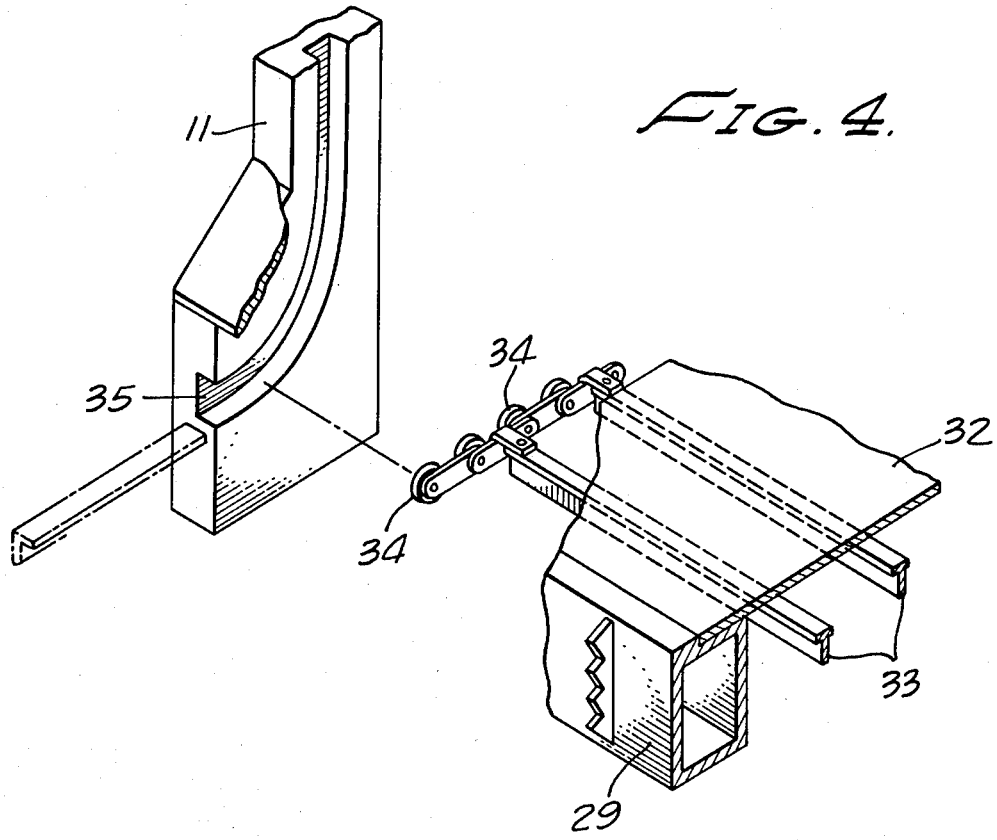
FIG. 4 is a sectional detail, partly broken away, showing mounting of the pusher element belt with respect to a wall of the loading chamber.

A pusher element 29 is mounted in the lower portion of the loading compartment 16 adjacent the floor 14 and extending between the side walls 11 and 12. The height of the pusher element 29 is such that it can pass below the ejector 20 when the compactor plate 24 is in the inclined position shown in FIGS. 1, 2 and 3 of the drawings. This pusher element 29 is moved toward and away from the storage chamber 15 by means of a pair of power cylinder assemblies 31. A wide flexible belt 32 is attached at its forward end to the pusher element 29 and, as best shown in FIG. 4, is supported on bars 33 carrying roller assemblies 34 at opposite ends of the bars. These roller assemblies are guided in grooves 35 provided on the side walls 11 and 12.

A multiple-extension power cylinder assembly 36 is pivotally connected at its forward end to a center portion of the compactor plate 24 and is pivotally connected at its other end to a fitting 37 fixed to the stationary ceiling wall 13.

In operation, refuse is deposited in the collection chamber 16 through a side opening in the wall 12. A quantity of relatively loose uncompacted refuse builds up in the collection chamber 16. The ejector 20 and compactor plate 24 are in the position shown in FIGS. 1, 2 and 3 of the drawings. The pusher element 29 is then moved from the retracted position shown in full lines in FIGS. 1 and 2 to the extended position shown in FIG. 5. Refuse is caused to move under the inclined lower surface 26 of the compactor plate 24, thereby compacting the refuse as it is moved into the storage chamber 15. Additional compaction may be obtained, if desired, by mounting triangular wedges 17 on the lower surface 26 of the compactor plate 24.

As the pusher element 29 moves toward the storage chamber 15, the wide flexible belt 32 moves with it to define the lower surface of the loading compartment 16. When the pusher element 29 is subsequently retracted, an additional quantity of refuse in the loading compartment 16 gravitates downward onto the floor 14 in front of the pusher element 29. Additional strokes of the pusher element 29 may be required to empty the loading compartment 16 and to compact this refuse as it is being transferred into the storage chamber 15.

When the storage chamber 15 is full to the extent desired, the pusher element 29 is retracted and the compactor plate 24 is swung about the hinge 25 to the position shown in FIG. 5 of the drawings. This motion is accomplished by the first part of the movement of the multiple-extension power cylinder 36. Continued lengthening of the power cylinder 36 causes the ejector 20 with its compaction plate 24 to move away from the storage compartment 16 through an open rear door of the storage chamber 15. The entire load of compacted refuse in the storage chamber 15 is thus discharged through a rear door opening without requiring tilting of the body 10. The multiple-extension power cylinder 36 may then be employed to retract the ejector 20 with its compaction plate 24 back to its initial position shown in FIG. 2.

The storage chamber 15 is wider at the top than at the bottom to promote the movement of refuse upward and to allow springback action to oppose its gravity descent.

Having fully described my invention, it is to be understood that I am not to be limited to the details herein set forth but that my invention is of the full scope of the appended claims.

I claim:

1. In a side loading refuse truck body, the combination of: walls and a floor forming a longitudinal storage chamber and a side loading compartment at the forward end thereof, an ejector guided for longitudinal movement in said storage chamber for ejecting refuse therefrom, said ejector in a forward position defining the rear boundary of the loading compartment, said ejector having a compactor plate movably mounted on the lower portion thereof, said compactor plate being movable between a first position in which a lower surface thereof is inclined downward away from said loading compartment to a second position adjacent the floor of the storage chamber, said ejector substantially filling the cross section of said storage chamber when the compactor plate is in its second position, means for moving the ejector to discharge refuse from said storage chamber, and a pusher element in the lower portion of the loading compartment movable toward the storage chamber for moving a charge of refuse from the loading compartment under said compactor plate and into the storage chamber, said compactor plate serving to compact the charge of refuse as it moves from the loading compartment into the storage chamber.

2. The combination set forth in claim 1 in which tapered restrictor wedges are mounted on the lower surface of said compactor plate.

3. The combination set forth in claim 1 in which the storage chamber and the loading compartment have floors in substantially the same plane.

4. In a side loading refuse truck body, the combination of: walls and a floor forming a longitudinal storage chamber and a side loading compartment at the forward end thereof, an ejector guided for longitudinal movement in said storage chamber for ejecting refuse therefrom, said ejector in a forward position defining the rear boundary of the loading compartment, said ejector having a compactor plate hinged to the lower portion thereof, said compactor plate being movable between a first position in which the lower surface thereof is inclined downward away from said loading compartment to a second position adjacent the floor of the storage chamber, said ejector substantially filling the cross section of said storage chamber when the compactor plate is in its second position, power means connected to said compactor plate for swinging it relative to the remainder of said ejector and for moving the ejector to discharge refuse from said storage chamber, and a pusher element in the lower portion of the loading compartment movable toward the storage chamber for moving a charge of refuse from the loading compartment under said compactor plate and into the storage chamber, said compactor plate serving to compact the charge of refuse as it moves from the loading compartment into the storage chamber.

5. The combination set forth in claim 4 in which tapered restrictor wedges are mounted on the lower surface of said compactor plate.

6. The combination set forth in claim 4 in which the storage chamber is wider at the top than at the bottom.

* * * * *